US011612823B2

(12) United States Patent
Thompson et al.

(10) Patent No.: US 11,612,823 B2
(45) Date of Patent: Mar. 28, 2023

(54) WATERSLIDE

(71) Applicant: Frustration Free Solutions, LLC, Twin Falls, ID (US)

(72) Inventors: Nathan Thompson, Twin Falls, ID (US); Jimmy Morrison, Springville, UT (US)

(73) Assignee: Frustration Free Solutions, LLC, Twin Falls, ID (US)

( * ) Notice: Subject to any disclaimer, the term of this patent is extended or adjusted under 35 U.S.C. 154(b) by 0 days.

(21) Appl. No.: 17/332,558

(22) Filed: May 27, 2021

(65) Prior Publication Data

US 2021/0370190 A1 Dec. 2, 2021

Related U.S. Application Data

(60) Provisional application No. 63/030,529, filed on May 27, 2020.

(51) Int. Cl.
*A63G 21/18* (2006.01)

(52) U.S. Cl.
CPC ..... *A63G 21/18* (2013.01)

(58) Field of Classification Search
CPC ..... A63G 21/00; A63G 21/18; A63G 31/007
USPC ..... 472/117, 128
See application file for complete search history.

(56) References Cited

U.S. PATENT DOCUMENTS 1,871,571 A * 8/1932 Weber ..... B63B 19/12 428/137
3,987,592 A * 10/1976 Herminghaus ..... B29C 66/435 428/192
9,072,978 B2 7/2015 Thayer
2016/0206964 A1* 7/2016 Goldreyer ..... A63G 21/18

* cited by examiner

*Primary Examiner* — Kien T Nguyen
(74) *Attorney, Agent, or Firm* — Dentons Durham Jones Pinegar

(57) ABSTRACT

This waterslide system or assembly that may allow for easy expansion of waterslides and more particularly an assembly and method for fixing a waterslide to a planar surface, or ground. The assembly may include reinforced portions of the waterslide which include apertures are allow for piercing of the reinforced portions to create apertures. The system may include a first sheet of material and subsequent sheets of material that may be the same or separate materials. A plurality of anchors may pass through the reinforced portions including the first sheet and subsequent sheets and fix the sheet(s) to the planar surface. The reinforced portions may be fixed to the sheet(s) through adhesion, sewing, weaving, welding, or other means. The reinforced portions may further include a flap that may comprise the same material as the reinforced portion itself.

23 Claims, 11 Drawing Sheets

WATERSLIDE

CROSS REFERENCE TO RELATED APPLICATION

A claim for priority to the May 27, 2020 filing date of U.S. Provisional Patent Application No. 63/030,529, titled WATERSLIDE ("the '529 Provisional Application"), is hereby made pursuant to 35 U.S.C. § 119(e). The entire disclosure of the '529 Provisional Application is hereby incorporated herein

TECHNICAL FIELD

This disclosure relates generally to various methods and embodiments of a waterslide. More specifically, it relates to methods of arranging and using a waterslide that may comprise one or more sheets of polymer or plastic having several reinforcing portions or strips that may receive anchors to hold the water slide in place. The features disclosed herein are numerous in nature and may be employed in various ways to provide the same or similar results.

BACKGROUND

Waterslides have been around for decades and been enjoyed by individuals young and old. One of the first instances of protection of a waterslide for domestic use can be found in U.S. Pat. No. 2,982,547 (which is incorporated by reference herein, in its entirety). The company Wham-O maintains a trademark for a waterslide that is endearingly titled SLIP 'N SLIDE®. Many different patents have been filed on these pieces of aquatic play equipment. Additionally, the enjoyment of the waterslides has spanned generations. Recently individuals have desired to increase lengths or widths of these waterslides. Events are often held during summer months and large waterslides are constructed at even greater widths and lengths to span more than a typical house yard or lawn.

For purposes of this disclosure, "waterslide(s)" shall mean any material that has a longitudinal length that is generally flat and smooth that a user slides on that may be sprayed with water or soap that is secured to the ground and that a user slide along. Often waterslides are comprised of plastic or rubber or other known polymer. Large waterslides are often constructed of either one, large piece of material or alternatively, multiple small pieces of material connected to each other. Securing of the waterslides to the ground has proved challenging while not ripping the polymer slide or injury to a user. Additionally, connecting of multiple waterslides requires a feature that allows you to secure multiple pieces together and maintaining that connection while getting wet. Multiple waterslides are often connected with tap, glue, plurality of anchors, or other clips and run the risk of not staying connected with continued use and with continued exposure to water. Additionally, the issue of safety in the use of these waterslides has continually been a concern as anchors may not remain completely flush with the waterslide or anchored to the ground and to the waterslide.

Current devices fail to provide a user an option of safely connecting multiple waterslides together, while securing the waterslides to the ground. The following description provides the ability to secure the waterslide to the ground and multiple slides together with while providing a safe sliding experience for a user.

SUMMARY

This disclosure relates to various methods and embodiments of a waterslide. More specifically, this disclosure relates to a method for assembling a waterslide or waterslide anchors.

A method for assembling a waterslide may comprise selecting a waterslide with the waterslide comprising: first sheet of material comprising, a top surface, a bottom surface opposite the top surface, and a plurality of anchors, comprising a securing portion connected to at least one elongated prong. Additionally, the method includes fixing at least one reinforcing portion to the sheet of material, piercing a first aperture through the first sheet of material and the at least one reinforcing portion, spreading the first sheet of material over a planar surface in a generally taut position; and also securing the first sheet of material to the planar surface in the generally taut position by piercing the at least one elongated prong of the plurality of anchors through the first aperture and into the planar surface.

The method may further include at least one elongated prong comprising a first elongated prong and a second elongated prong with the securing portion connecting each prong in a non-parallel or perpendicular manner.

The method may further include spreading a second sheet of material over the planar surface in a position that is adjacent to the first sheet of material and securing the second sheet of material to the planar surface with a first of the plurality of anchors. A user may connect adjacent lateral sides of the first sheet of material and the second sheet of material to one another by passing a second of the plurality of anchors through a second aperture in the first sheet of material and corresponding third aperture in the second sheet of material and into the planar surface, which may widen the waterslide.

The method may alternatively, or additionally, include spreading a second sheet of material out over the planar surface, a proximal end of the second sheet of material being positioned under a distal end of the first sheet of material. The method may also include securing the second sheet of material to the planar surface with the plurality of anchors and connecting the distal end of the first sheet of material and the proximal end of the second sheet of material together by passing a first of the plurality of anchors through a second aperture in the first sheet of material and corresponding third aperture in the second sheet of material, which would lengthen the slide.

The first sheet of material may comprise a polymer. The plurality of reinforcing portions may comprise a woven fabric which may be a combination of threads. Furthermore, the plurality of reinforcing portions may be fixed to the first sheet around a perimeter of the first sheet.

The plurality of reinforcing portions may be fixed to the first sheet with an adhesive or via welding, either through heat, ultrasonic or other means.

Finally, the method may include arranging for a source of water to wet the top surface of the first sheet of material.

An alternate method of using a waterslide, may include selecting the waterslide, wherein the waterslide may comprise a first sheet which may comprise a first material. The waterslide may also include a plurality of reinforcing strips with a first portion adhered to the first sheet and a second portion adhered to itself forming a flap, wherein each reinforcing strip may comprise a flap. The waterslide assembly may also include a plurality of anchors, which may be primarily a staple-like shape including a securing portion connected to a plurality of elongated prongs. The method may further include fixing the plurality of reinforcing strips to the first sheet and then piercing a plurality of holes through the flap. Additionally, the method may include, placing the sheet of plastic on a planar surface in an extended position and then securing the first sheet to the planar surface by pushing the plurality of elongated prongs of the plurality of anchors through the plurality of holes and into the planar surface. Finally, the method may include providing a source of water to the first sheet of material and then sliding down the planar surface across the first sheet.

The method of assembling a waterslide may further include spreading a second sheet of a first material over the planar surface in a position that is adjacent to the first sheet and securing the second sheet to the planar surface with the plurality of anchors. Additionally, a user may reversibly fix the first sheet and second sheet on adjacent lateral sides of each of the first and the second sheet to one another by inserting a number of the plurality of anchors through a first set of holes in a first flap adhered to the first sheet and corresponding second set of holes in the second sheet of material and into the planar surface, which may widen the slide.

Alternatively, the method of assembly may comprise spreading a second sheet of the first material over the planar surface using a proximal end of the second sheet and placing it under a distal end of the first sheet. Securing the second sheet to the planar surface may include use of the plurality of anchors by connecting the distal end of the first sheet and the proximal end of the second sheet together by passing at least one of the plurality of anchors through a first set of holes in a first flap adhered to the distal end of the first sheet and corresponding second set of holes at the proximal end of the second sheet, which may lengthen the waterslide.

The plurality of reinforcing strips may comprise a woven fabric. The plurality of reinforcing strips may be fixed to the first sheet around a periphery.

A waterslide assembly may include the following: a first sheet of a first material, the first sheet may include a top surface and a bottom surface opposite the top surface. A plurality of reinforcing portions may be fixed to the bottom surface of the sheet of material around a perimeter of the sheet of material and aa plurality of anchors, comprising a staple-like shape may include a securing portion connected to a plurality of elongated prongs. The sheet of material may be reversibly fixed to planar surface with the bottom surface facing down, with the sheet of material being secured in place by the plurality of anchors passing through the plurality of apertures and into the planar surface.

The plurality of reinforcing portions may each comprise a first portion adhered to the first sheet and a second portion adhered to itself forming a flap. Furthermore, the plurality of apertures may pass through at least a portion of the plurality of reinforcing portions.

The assembly may further include a second sheet of a second material with reinforcing portions, the second sheet adjacent to the first sheet; the second sheet may be secured to the planar surface with the plurality of anchors wherein the plurality of anchors may pass through at least a portion of the plurality of reinforcing portions. The first sheet and the second sheet may be connected at adjacent lateral sides by inserting a number of the plurality of anchors through the first sheet and the second sheet and into the planar surface, thus widening the waterslide.

Alternatively, a second sheet may comprise a second material with reinforcing portions, the second sheet having a proximal end that is positioned at least partially under a distal end of the first sheet and the second sheet being secured to the planar surface with the plurality of anchors, wherein the plurality of anchors may pass through at least a portion of the plurality of reinforcing portions. The distal end of the first sheet and the proximal end of the second sheet may be reversibly fixed together by passing at least one of the plurality of anchors through at least one of reinforcing portion at the distal end of the first sheet and corresponding reinforcing portion at the proximal end of the second sheet, thus lengthening the waterslide.

The first material and second material may be the same and may be polymers including plastics, rubbers, or the like. The reinforcing portions may be a woven fabric as well.

DETAILED DESCRIPTION

Figure 1:
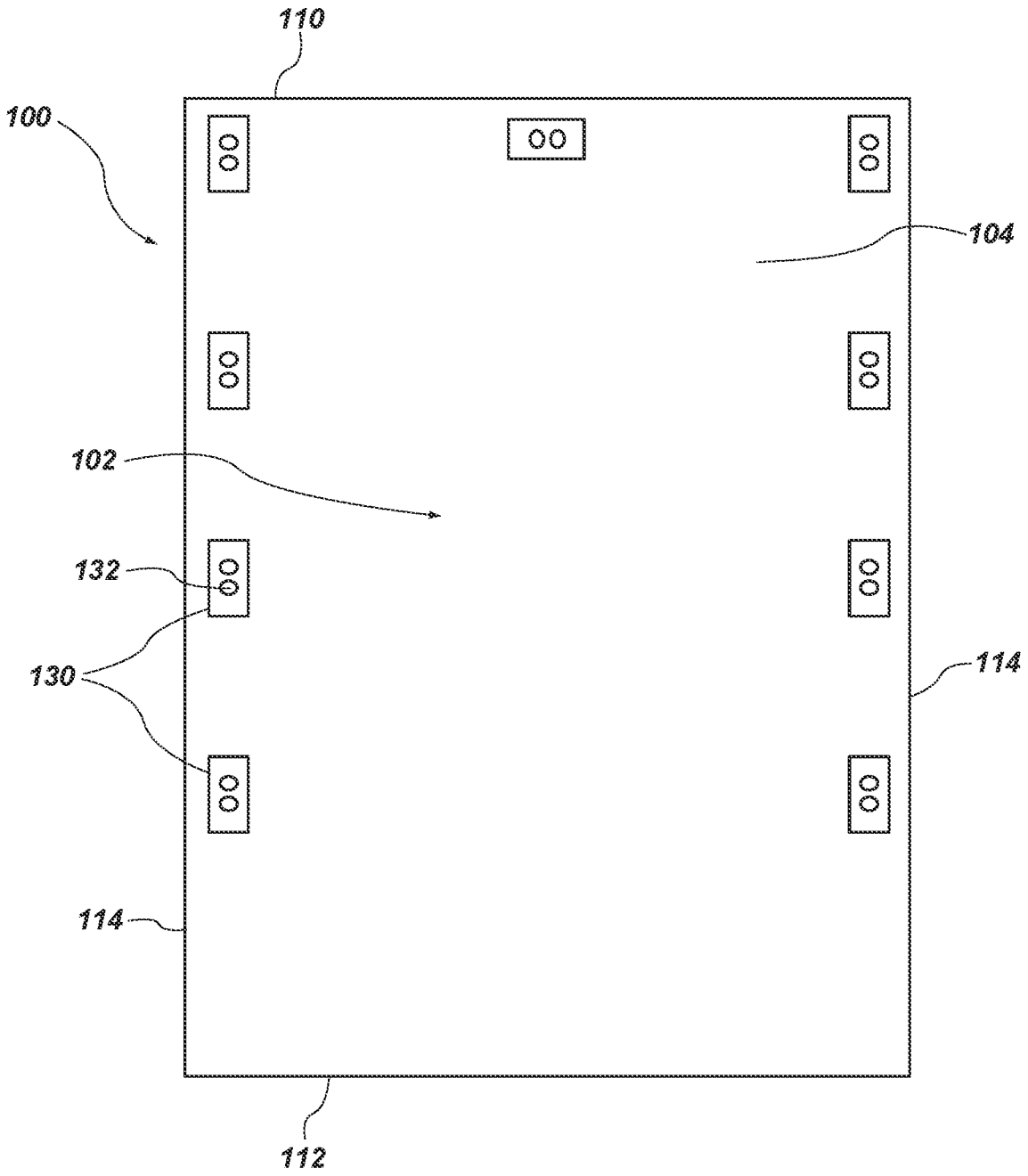
FIG. 1 is a bottom view of a waterslide with at least one reinforcing strip.
Figure 2:
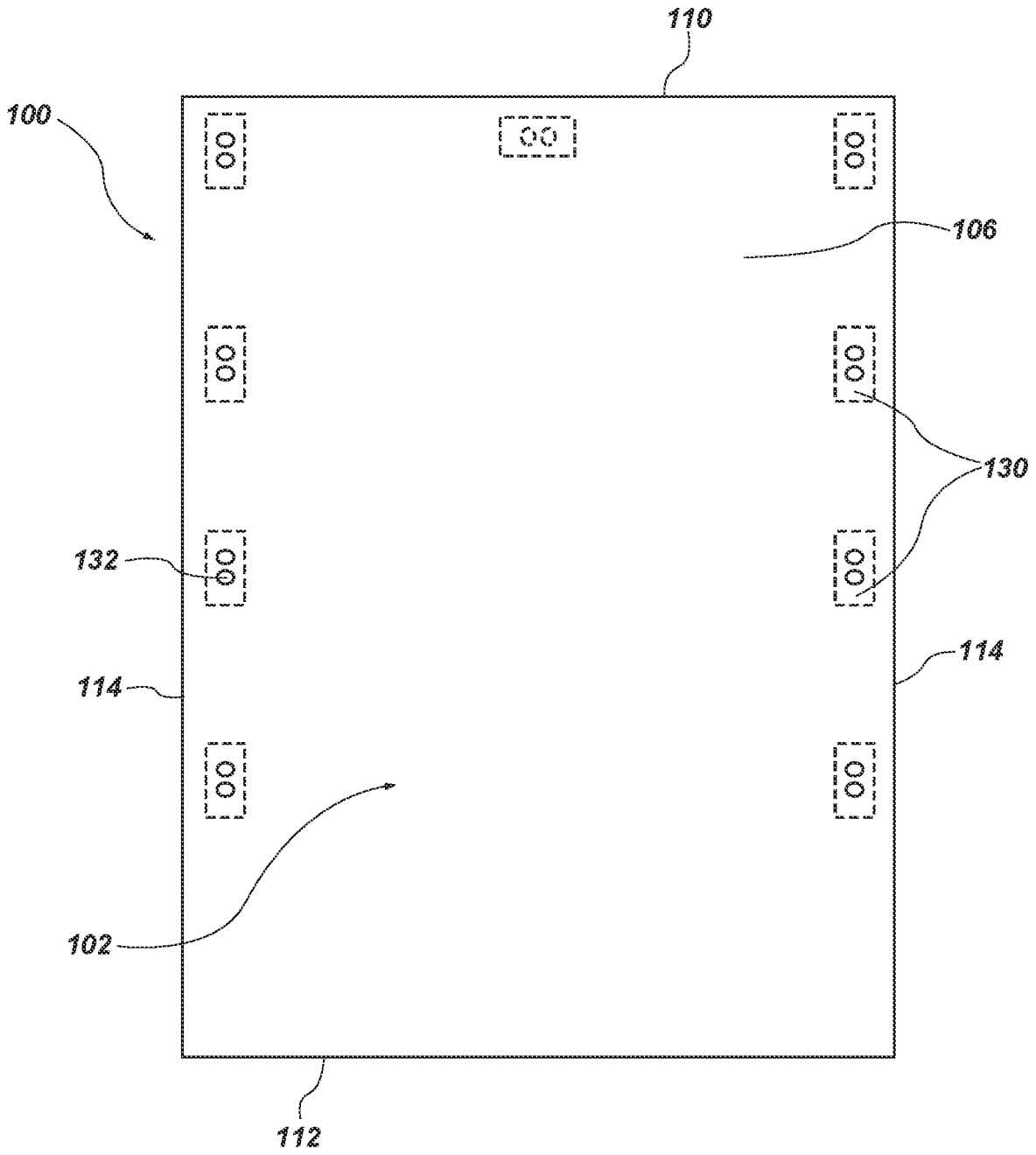
FIG. 2 is a top view of the waterslide of FIG. 1.

FIGS. 1-2 illustrate an embodiment of a waterslide 100, which may be a slip-n-slide. The waterslide 100 may comprise a sheet of material 102 with a bottom surface 104 and a top surface 106. The sheet of material 102 may be made of a variety of different materials. By way of example, and not limitation, the sheet of material 102 may comprise a tarp (a tarpaulin sheet or cover), a single sheet of plastic, a sheet of rubber, a sheet of another known polymer. Additionally, the waterslide 100 may also be comprises of multiple sheets of material fixed or adhered together (one on top of the other) to the top and/or bottom of the first sheet of material. The additional sheets may provide greater durability of the waterslide. Furthermore, the material may be comprised of a single sheet of highly durable plastic, rubber or other polymer. Alternatively, to save on weight the sheet(s) may be thinner to provide ease in manipulating and carrying the waterslide 100 and to limit the weight of the waterslide 100. The waterslide 100 may also comprise multiple sheets of material that are connected in a sequence, consecutively, end-to-end, or side to side to each other to increase a length or width of the waterslide 100.

The waterslide 100 may take many different shapes and sizes depending on the use thereof. By way of example, and not limitation, the sheet of material 102 of the waterslide 100 may form the shape of a rectangle, which may be elongated.

The sheet of material 102 may be used to create a sliding surface for users to slide on. For example, the sheet of material 102 may be pulled generally taut and positioned over a planar surface, which may be grassy plane, a hill or other surface which may be substantially flat or inclined. The sheet of material 102 may have a proximal end 110 and a distal end 112. The proximal end 110 may be positioned at a beginning of a planar surface, top of the hill or other inclined surface and a distal end 112 positioned at an end the planar surface or downhill relative to the proximal end 110. The sheet of material 102 may be laid over the planar surface or the hill or other inclined surface with the bottom surface 104 facing the planar surface or the hill or inclined surface and the top surface 106 facing upward, which may allow the top surface 106 to be used as a sliding surface for users to slide on.

The sheet of material 102 may be used in various other ways to create a sliding surface as well. For example, the sheet of material 102 may be pulled taut and positioned over a flat, or relatively flat planar surface. Users may choose to walk or run toward the sheet of material 102 and propel themselves onto the waterslide 100 to slide across the top surface 106 of the sheet of material 102.

Water and other liquids (e.g., liquid soap) may be added to the top surface 106, which may cause the top surface 106 to become more slippery or slick, which may facilitate sliding thereon. By way of example, an irrigation hose or other source of water may be configured to continually provide water to the sheet of material 102, which may serve to lubricate the top surface 106 and facilitate sliding thereon. Various other means of providing water or other liquids to the waterslide 100 may be incorporated into the waterslide 100 as well, including, but not limited to, placing the sheet of material 102 near sprinklers, manually adding liquids to the top surface 106, etc.

The waterslide 100 may also comprise a plurality of anchors 120 (see FIG. 3), which may be used to secure the sheet of material 102 in place after the sheet of material has been pulled to a generally or sufficiently taut position. The plurality of anchors 120 may differ in shape and size depending on the intended use thereof. The anchors may resemble a hook, a staple, or large staple, with two protruding parallel poles connected by a single non-parallel or even perpendicular pole. Another example of the plurality of anchors 120 may comprise at least one of: an elongated pole with a tapered/pointed distal end configured to penetrate the ground and a hook/loop on another side; an elongated stick with a tapered/pointed end on one side and a securing member, such as an intersecting the pole on the other end; and other forms of common tent stakes or securing anchors. Alternatively, the anchor 120 may include to prongs with a tether between them that may be made of a fabric or similar material sufficient to hold the prongs together while providing a securement mechanism to the waterslide 100.

Figure 3:
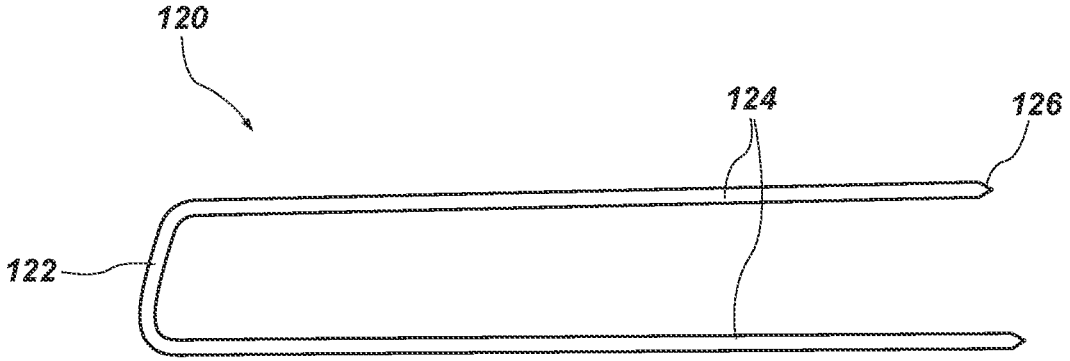
FIG. 3 is a, perspective view of one embodiment of an anchor.

Referring to FIG. 3, the plurality of anchors 120 may comprise a staple-like shape with a securing portion 122 that may be connected to a plurality of elongated prongs 124. The securing portion 122 and the plurality of elongated prongs 124 may form one unitary piece or may be separate pieces that have been fixed to one another. The elongated prongs 124 may be substantially parallel while the securing portion 122 may be non-parallel or perpendicular to the elongated prongs 124. The plurality of elongated prongs 124 may comprise tapered ends 126 opposite the securing portion 122. The tapered ends 126 may be pointed or sharpened to facilitate easier use of the anchors. FIG. 3 illustrates that the plurality of elongated prongs 124 may comprise two elongated prongs. However, in other embodiments, the plurality of anchors 120 may include a single prong or additional elongated prongs. Other embodiments may also include additional securing portions.

The plurality of anchors 120 may be used by pushing the tapered ends 126 of the elongated prongs 124 through the sheet of material 102 and inserting the elongated prongs 124 into the ground or surface directly beneath the sheet of material 102 until the securing portion 122 rests against, or flush with, the sheet of material 102. The plurality of anchors 120 may be used to secure a perimeter of the sheet of material 102 to the ground beneath the sheet of material 102 in such a way that the sheet of material 102 may be held in place in a taut, generally taut, or extended position. When users are finished using the waterslide 100, they may remove the plurality of anchors 120 from the ground and the sheet of material 102 and fold up the sheet of material for portage and storage.

The planar surface, ground, or other surface beneath the sheet of material 102 may comprise a grassy area, which may provide users with a somewhat cushioned sliding experience. When the waterslide 100 has been situated over a grassy hill or surface, pushing the plurality of anchors 120 through the sheet of material 102 and into the ground may be done by manually pushing the anchors through the sheet of material 102 and into the ground. However, if desired, a user may also use a hammer, mallet, or other tool to drive the plurality of anchors 120 through the sheet of material 102 and into the ground or surface below the sheet of material 102.

Referring, once again, to FIGS. 1 and 2, the sheet of material 102 may also comprise a plurality of reinforcing portions 130, or strips. The plurality of reinforcing strips 130 may comprise a strip of reinforcing material which may be fixed to the sheet of material 102 in various ways, including, but not limited to, by an adhesive placed on the reinforcing strips 130 and/or the sheet of material 102, by welding (e.g., ultrasonic, heat, etc.) the reinforcing strips 130 to the sheet of material 102, by sewing the reinforcing strips 130 to the sheet of material 102, etc.

The plurality of reinforcing strips 130 may comprise various sizes and shapes of reinforcing strips depending on the intended use thereof. FIGS. 1-2 illustrate that the plurality of reinforcing strips 130 may comprise a rectangular shape which may dimension similar to dimensions of a strip of duct tape. In other embodiments, the plurality of reinforcing strips 130 may comprise elongated reinforcing strips that may extend along an entire length and/or width of the sheet of material 102 around the perimeter of the sheet of material 102. In such embodiments, the elongated reinforcing strips may reinforce a portion of a perimeter of the waterslide 100 or the entire perimeter of the waterslide 100.

The plurality of reinforcing strips 130 may comprise a variety of different materials as well and may comprise "tarp tape." For example, the plurality of reinforcing strips may comprise a variety of woven fabrics to provide strength. These woven fabrics may comprise a combination of threads including at least one of cotton, polyester, nylon, rayon, or fiberglass. Other embodiments of reinforcing strips may comprise non-woven materials and other natural or synthetic fibers. The tarp tape may include a number of layers of materials or fabrics including a layer of factice, a layer of fiberglass and a layer of thermoplastic film. The layers may be placed in that order or other order, as necessary. Release paper may be placed on the adhesive side to allow the adhesive side to be exposed easily.

As was mentioned previously, the plurality of reinforcing strips 130 may be fixed to the sheet of material 102 via an adhesive. The adhesive used may be water resistant and/or impermeable. The adhesive may be used to fix the plurality of reinforcing strips 130 to the sheet of material 102 in various ways. The plurality of reinforcing strips 130 may, for example, comprise a top surface and a bottom surface, the bottom surface comprising an adhesive, similar to a strip of tape. In such embodiments, the plurality of reinforcing strips 130 may be applied to the sheet of material by placing the bottom surface of the reinforcing strip directly on the sheet of material 102 and pressing it down so that it is flush against the sheet of material 102.

The plurality of reinforcing strips 130 may be fixed to the sheet of material 102 on either of the top surface 106 and/or the bottom surface 104 depending on the preferred use of the plurality of reinforcing strips 130. Placing the plurality of reinforcing strips solely on the bottom surface 104 of the sheet of material 102 may, as is illustrated in FIGS. 1 and 2, may keep the plurality of reinforcing strips 130 from being readily apparent and providing a smooth top surface 106. The plurality of reinforcing strips 130 may also be fixed to the sheet of material 102 in various locations along the top surface 106 and/or bottom surface 104 of the sheet of material depending on the intended use thereof.

The plurality of reinforcing strips 130 may be fixed to the bottom surface of 104 the sheet of material 102 and may be positioned along the perimeter of the sheet of material 102 each reinforcing strip equidistant from the other but may alternatively be placed at predetermined intervals along the perimeter or even randomly. FIGS. 1 and 2 illustrate that the plurality of reinforcing strips 130 may be positioned proximate to the perimeter of the sheet of material 102 along the proximal end 110 and lateral sides 114 of the sheet of material 102, but not along the distal end 112 of the sheet of material 102. Other embodiments, however, may comprise additional reinforcing strips 130 along the distal end 112 of the sheet of material 102 or along on any other part of the sheet of material if desired. It will be appreciated that more anchors and reinforcing strips may be required toward the proximal end 110 than toward the distal end 112 if that is where a user may first engage the waterslide 100. However, the waterslide 100 may be completely interchangeable from proximal end 110 and distal end 112 and from top surface 106 and bottom surface 104.

The waterslide 100 may entirely uniform with no holes or blemishes. Alternatively, the waterslide 100 may also comprise a plurality of apertures 132, or holes or perforations. The plurality of perforations 132 may comprise a number of holes or apertures that extend through both the plurality of reinforcing strips 130 and the sheet of material 102. The plurality of perforations 132 may be sized and shaped to receive the plurality of anchors 120. In other words, the plurality of perforations may be sized and shaped so that the elongated prongs 124 of the plurality of anchors 120 may pass through the sheet of material 102, through the plurality of reinforcing strips 130, and into the ground beneath the sheet of material 102, thereby anchoring the sheet of material 102 to the ground.

The plurality of perforations 132 may comprise, for example, two holes positioned on each reinforcing strip of the plurality of reinforcing strips 130, the two holes extending through the sheet of material 102 and the plurality of reinforcing strips 130. The two holes may be configured to receive the elongated prongs 124 of the plurality of anchors 120. In other words, the two holes may be sized, shaped, and oriented in such a way that the elongated prongs 124 may pass through the two holes and into the ground. As the plurality of anchors 120 are inserted into the ground, the securing portion 122 of each anchor may rest flush against the sheet of material 102 (or the reinforcing strips 130, if the reinforcing strips 120 are situated on the top surface 106 of the sheet of material 102), and the securing portion 122 may extend the distance between the two holes. In the alternative, a user may utilize the anchors 120 to pierce the waterslide 100, and the reinforcing strips 130, to create the perforations 132 or apertures.

While FIGS. 1 and 2 may show a lack of reinforcing strips 130 toward the distal end 112 it will be appreciated that reinforcing strips 130 may be positioned anywhere on the periphery of the waterslide 100. Additionally, or alternatively, the reinforcing strips 130 may be scattered away from the periphery as well so long as they lay flush against the ground. Further, it may be important to reinforce corners of the waterslide 100 so that they do not come up while in use and additional reinforcing strips 130 are contemplated.

Figure 4:
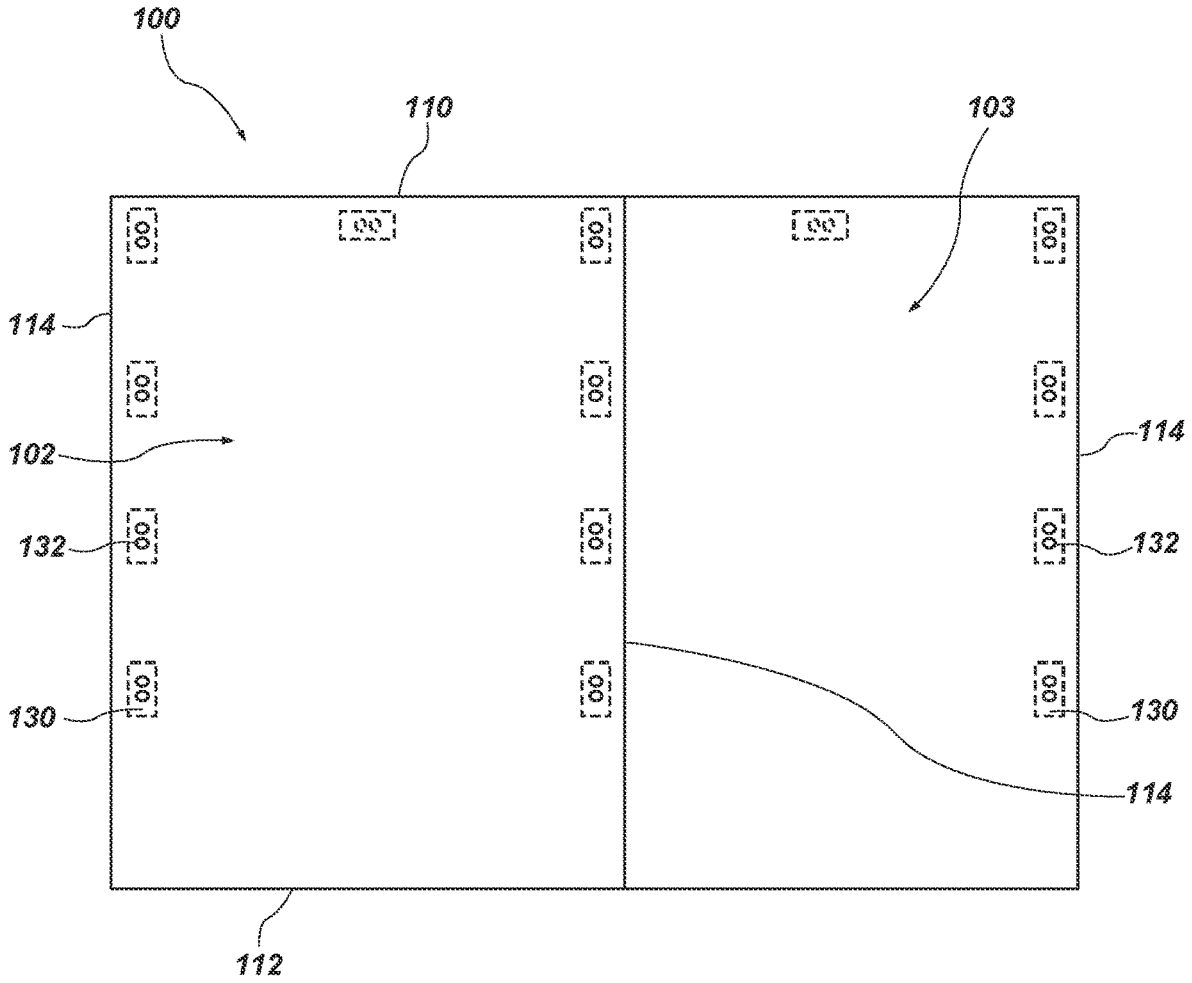
FIG. 4 is a top view of the waterslide of FIG. 1 and an additional waterslide in one configuration.
Figure 5:
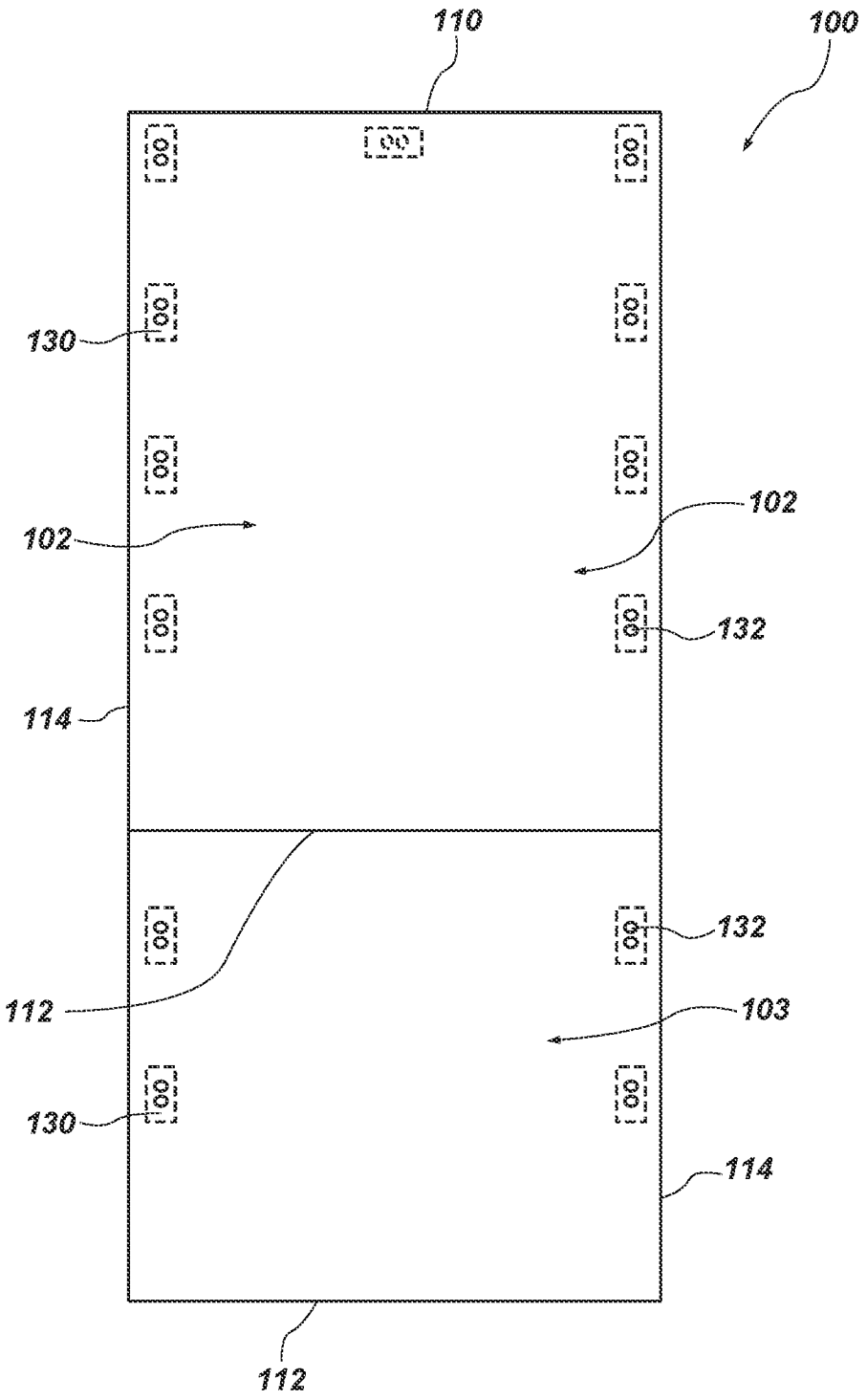
FIG. 5 is a top view of the waterslide of FIG. 1 and an additional waterslide in a separate configuration.
Figure 6:
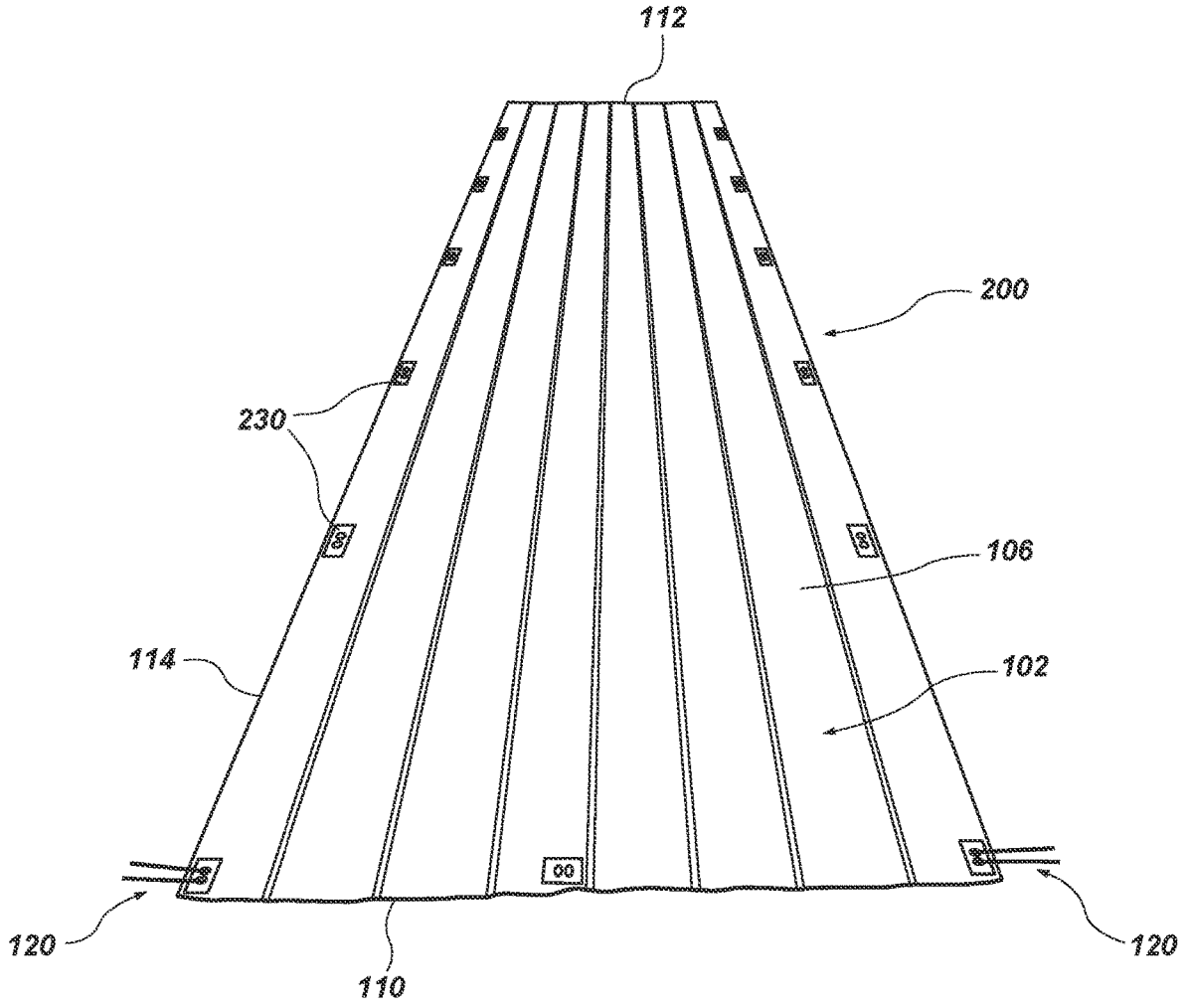
FIG. 6 is a top, perspective view of a waterslide.
Figure 7:
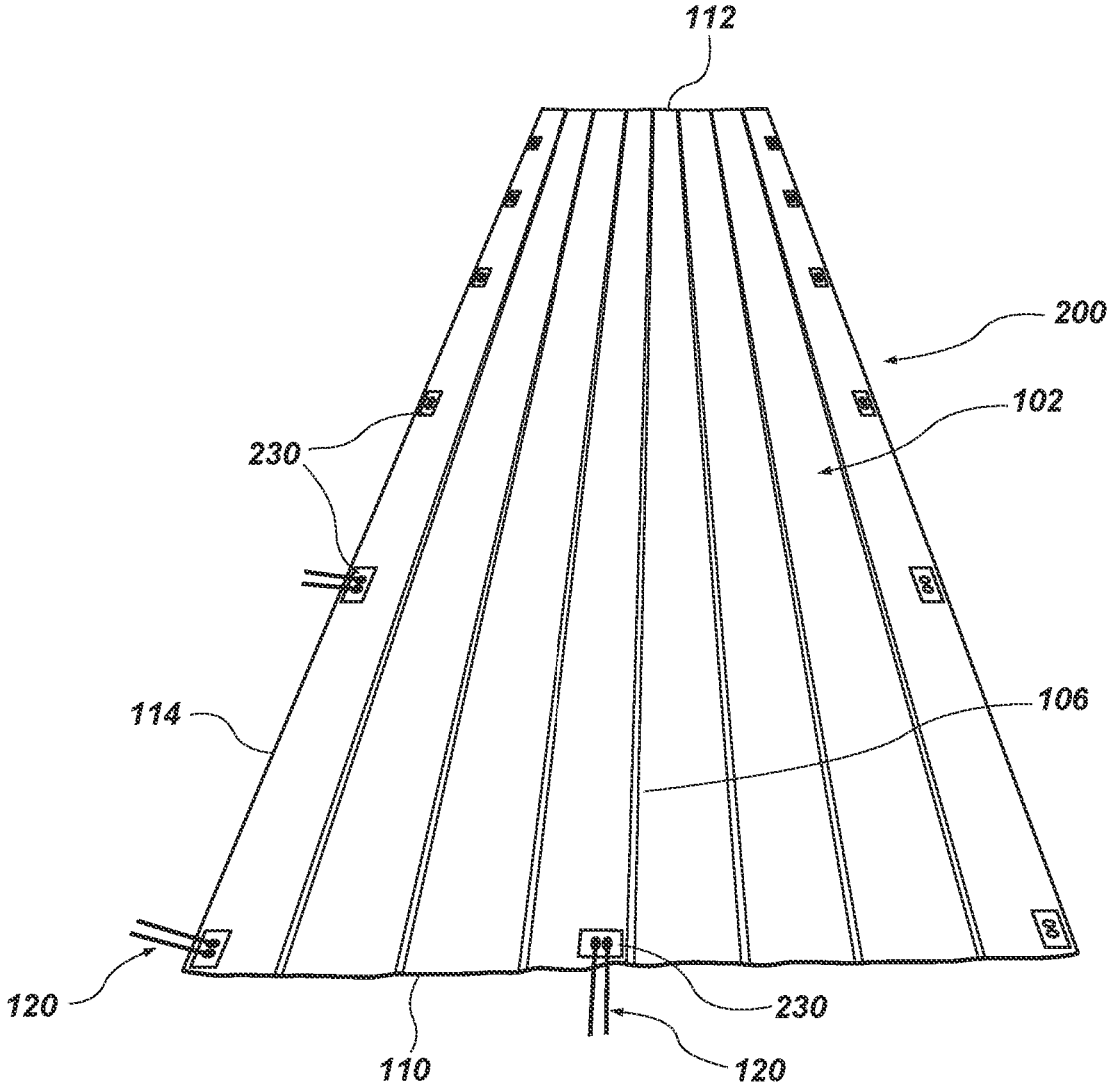
FIG. 7 is a bottom, perspective view the waterslide of FIG. 6 with at least one reinforcing strip.
Figure 8:
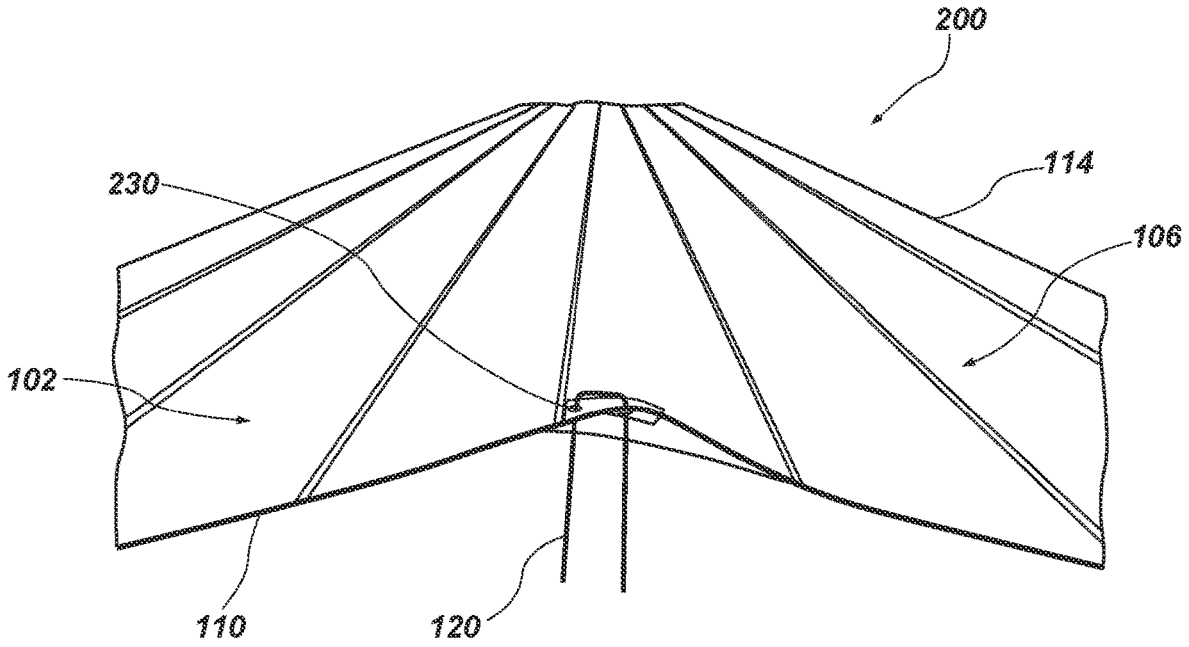
FIG. 8 is a top, perspective view of the waterslide of FIG. 6 with at least one anchor of FIG. 3.
Figure 9:
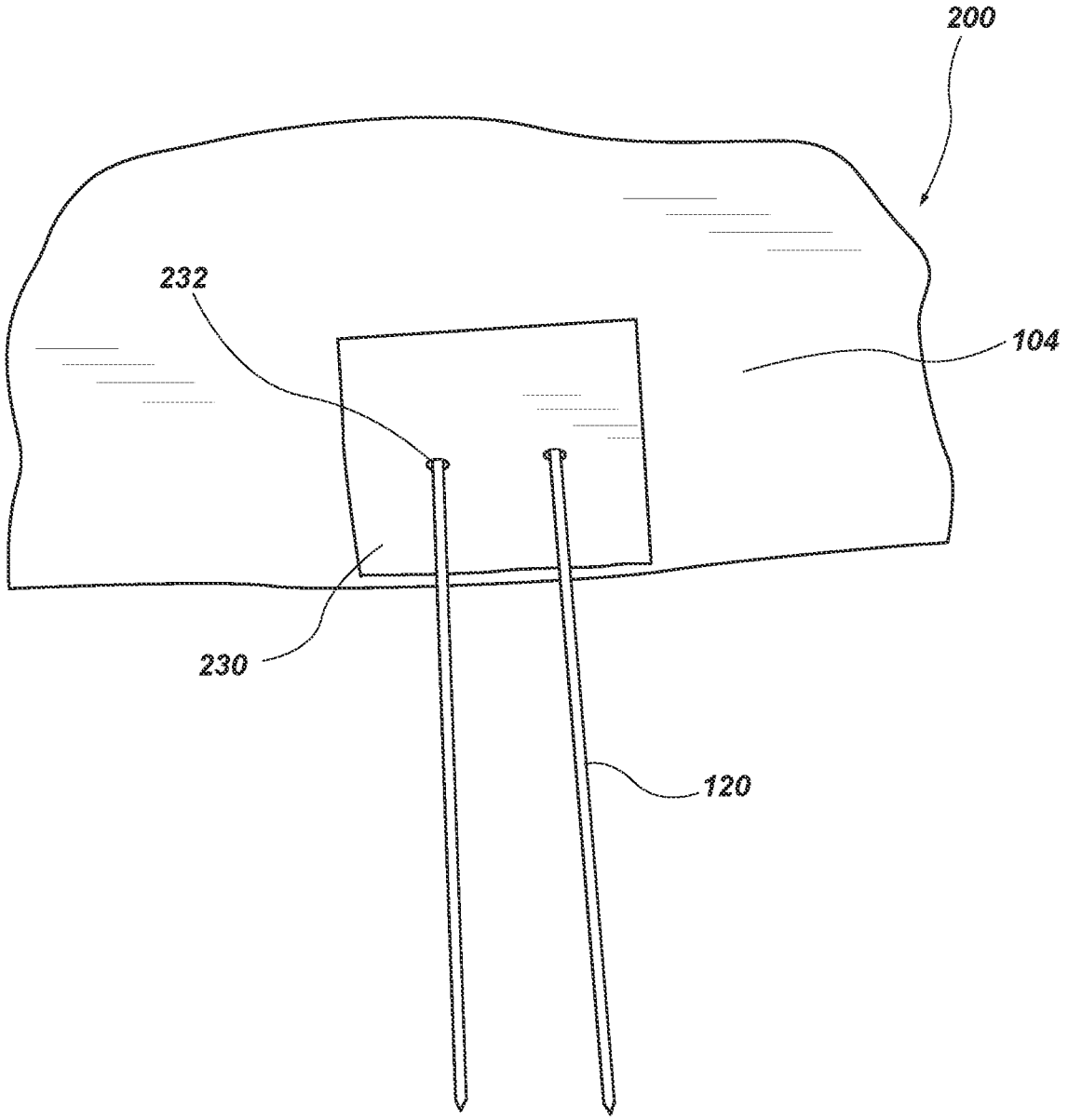
FIG. 9 is a magnified bottom view of a portion of the waterslide of FIG. 6 with at least one reinforcing strip and at least one anchor.

Referring to FIGS. 4 and 5, the waterslide 100 may also comprise a second sheet of material 103, which may be substantially similar to sheet of material 102. The sheet of material 102 may be combined with, or otherwise connected to, the second sheet of material 103, to widen a width of the waterslide 100 and/or extend a length of the waterslide 100. For example, a lateral side of the second sheet of material 103 may be situated adjacent to one of the lateral sides 114 of the sheet of material 102. The second sheet of material 103 may have reinforcing strips and perforations that correspond in location and orientation to the reinforcing strips 130 and perforations 132 of the sheet of material 102. The plurality of anchors 120 may then pass through the plurality of perforations 132 of the sheet of material 102, through the corresponding perforations in the second sheet of material 103, and into the ground beneath the sheets of material. This may connect to the two sheets of material to create a single, unified sliding surface upon which users may slide, and thereby extend the width of the waterslide 100. Once again, the first sheet of material 102 and second sheet of material 103 may be pierced with an anchor 120 or a plurality of anchors 120 creating perforations, holes, or apertures to fix the first and second sheets 102, 103 to the ground.

Alternatively, the sheet of material 102 and the second sheet of material 103 may be connected in a similar manner to extend the length of the waterslide 100. FIG. 5, for example, demonstrates that a proximal end of the second sheet of material 103 may be situated under, or adjacent to, the distal end 112 of the sheet of material 102. The sheet of material 102 and the second sheet of material 103 may be connected, or fixed to one another, as described above with the plurality of anchors 120 passing through both sheets of material and into the ground beneath them. This may connect the two sheets of material to create a single, unified sliding surface upon which users may slide, and thereby extend the length of the waterslide 100.

Additional sheets of material may be connected to one another in order to widen and/or lengthen the waterslide 100 depending on the intended use of the waterslide 100.

FIGS. 6-12 illustrate an embodiment of a waterslide 200, which may be substantially similar to waterslide 100. Waterslide 200 may comprise a sheet of material 202, which may be substantially similar to sheet of material 102. Waterslide 200 may also comprise a plurality of reinforcing strips 230, which may be similar to plurality of reinforcing strips 130. (See FIGS. 6-9).

Figure 10:
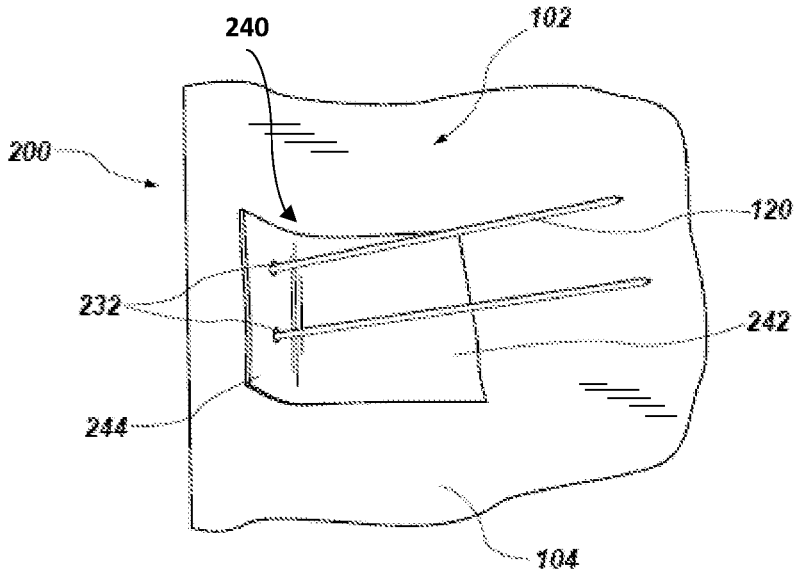
FIG. 10 is an alternate magnified bottom view of the waterslide of FIG. 6 with a different embodiment of at least one reinforcing strip.
Figure 11:
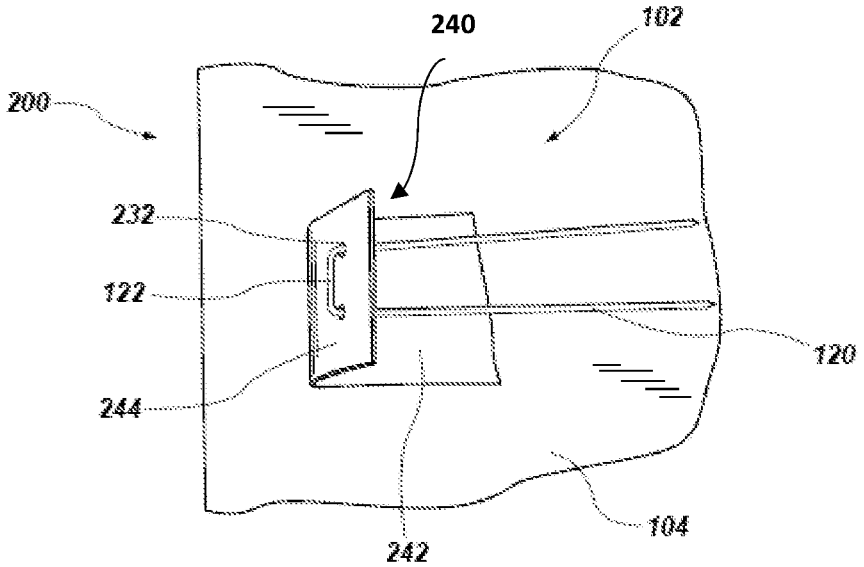
FIG. 11 is an alternate magnified bottom view of the waterslide of FIG. 6 with the reinforced strip in an alternate configuration.

Referring to FIG. 10 and FIG. 11, a waterslide 200 may additionally, or alternatively, comprise a plurality of reinforcing tabs 240. The plurality of reinforcing tabs 240 may comprise a reinforcing strip portion 242, which may be substantially similar to reinforcing strips 130. The plurality of reinforcing tabs 240 may also comprise a flap portion 244. The flap portion 244 may take many different shapes and forms. For example, the flap portion 244 may be an extension of the reinforcing strip portion 242 that is not fixed to the sheet of material 202. It may also be a separate element that may be coupled to the reinforcing strip portion 242. The flap portion 244 may simply be the same material as the reinforcing strip portion 242 which may be comprised of an adhesive on one side of the reinforcing strip (e.g., tape). The flap portion 244 may be a longer portion of the reinforcing tab 240 folded over on itself so that two adhesive sides of the reinforcing tabs 240 are adhered to each other rather than to the waterslide 200 while the reinforcing strip portion 242 is adhered to the waterslide 200. The flap portion 244 providing for increased reinforcement because of the double layer of the reinforcing tab 240.

The flap portion 244 of the plurality of reinforcing tabs 240 may comprise a plurality of perforations 232, which may be substantially similar to plurality of perforations 132, except that the plurality of perforations 232 may not pass through the sheet of material 102 but solely through the flap portion 244. Similar as previously described, the anchor(s) 120 may secure the waterslide 100 to the ground by holding the reinforcing tab 240 with the anchor 120 to the ground while the reinforcing strip portions 242 is fixed to the waterslide 100. The plurality of anchors 120 may pass through the plurality of perforations 232 and into the ground beneath the sheet of material 202 in order to secure the waterslide 200 in a taut, generally taut, or extended position.

Figure 12:
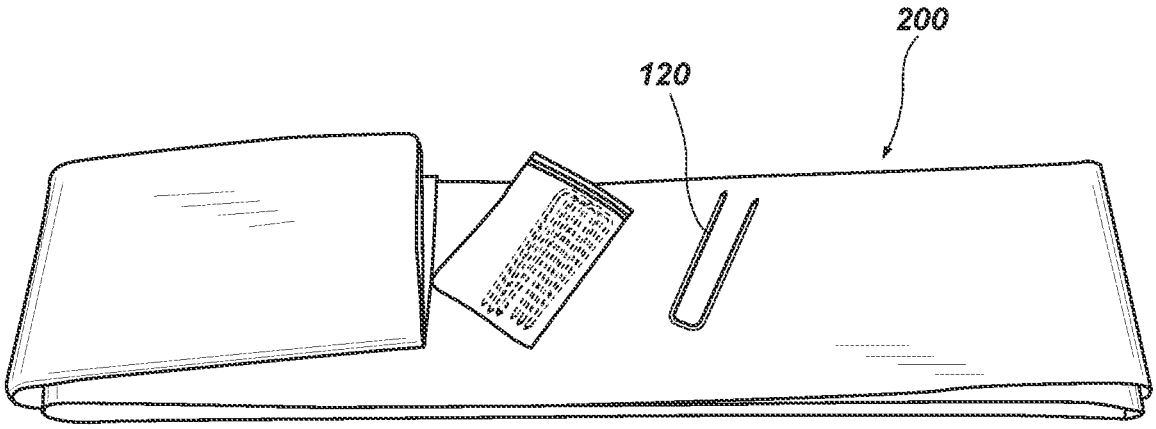
FIG. 12 is a perspective view of the waterslide of FIG. 6 in an unexpanded configuration.

Referring to FIG. 12, the waterslide 200 (or previous embodiment waterslide(s) 100) may be folded up into a more portable, compact form for easy portage and storage.

Although the foregoing disclosure provides many specifics, these should not be construed as limiting the scope any of the ensuing claims. Other embodiments may be devised which do not depart from the scopes of the claims. Features from different embodiments may be employed separately or in combination. Accordingly, all additions, deletions and modifications to the disclosed subject matter that fall within the scopes of the claims are to be embraced thereby. The scope of each claim is indicated and limited only by its plain language and the full scope of available legal equivalents to its elements.

What is claimed:

1. A method for assembling a waterslide, comprising:
selecting a waterslide, the waterslide comprising:
a first sheet of material comprising:
a top surface;
a bottom surface opposite the top surface; and
a plurality of anchors, comprising a securing portion connected to at least one elongated prong;
fixing at least one reinforcing portion to the sheet of material;
piercing a first aperture through the first sheet and the at least one reinforcing portion;
spreading the first sheet over a planar surface in a generally taut position; and
securing the first sheet to the planar surface in the generally taut position by piercing the at least one elongated prong of the plurality of anchors through the first aperture and into the planar surface.

2. The method of claim 1, wherein the at least one elongated prong comprises a first elongated prong and a second elongated prong with the securing portion connecting each prong.

3. The method of claim 2, further comprising:
spreading a second sheet of material over the planar surface in a position that is adjacent to the first sheet;
securing the second sheet to the planar surface with a first of the plurality of anchors; and
connecting adjacent lateral sides of the first sheet and the second sheet to one another by passing a second of the plurality of anchors through a second aperture in the first sheet and corresponding third aperture in the second sheet and into the planar surface, thereby widening the waterslide.

4. The method of claim 2, further comprising:
spreading a second sheet of material out over the planar surface, a proximal end of the second sheet being positioned under a distal end of the first sheet;
securing the second sheet to the planar surface with the plurality of anchors; and
connecting the distal end of the first sheet and the proximal end of the second sheet together by passing a first of the plurality of anchors through a second aperture in the first sheet and corresponding third aperture in the second sheet, thereby lengthening the waterslide.

5. The method of claim 1, wherein the first sheet comprises a polymer.

6. The method of claim 1, wherein the plurality of reinforcing portions comprises a woven fabric comprising a combination of threads.

7. The method of claim 1, wherein the plurality of reinforcing portions is fixed to the first sheet around a perimeter of the first sheet.

8. The method of claim 1, wherein the plurality of reinforcing portions is fixed to the first sheet with an adhesive.

9. The method of claim 1, wherein the plurality of reinforcing portions is fixed to the first sheet via welding.

10. The method of claim 1, further comprising arranging a source of water to wet the top surface of the first sheet.

11. A method of using a waterslide, comprising:
selecting a waterslide, the waterslide comprising:
a first sheet comprising a first material;
a plurality of reinforcing strips with a first portion adhered to the first sheet and a second portion adhered to itself forming a flap, wherein each reinforcing strip comprises a flap wherein the plurality of reinforcing strips, including the flap, are positioned entirely on a bottom surface of the first sheet; and
a plurality of anchors, comprising a staple-like shape including a securing portion connected to a plurality of elongated prongs;
fixing the plurality of reinforcing strips to the sheet of material;
piercing a plurality of holes through the flap;
placing the sheet of plastic on a planar surface in an extended position;
securing the first sheet to the planar surface by pushing the plurality of elongated prongs of the plurality of anchors through the plurality of holes and into the planar surface;
providing a source of water to the first sheet; and
sliding down the planar surface across the first sheet.

12. The method of claim 11, further comprising:
spreading a second sheet of a first material over the planar surface in a position that is adjacent to the first sheet;

securing the second sheet to the planar surface with the plurality of anchors; and reversibly fixing the first sheet and second sheet on adjacent lateral sides of each of the first and the second sheet to one another by inserting a number of the plurality of anchors through a first set of holes in a first flap adhered to the first sheet and corresponding second set of holes in the second sheet and into the planar surface, thereby widening the waterslide.

13. The method of claim 11, further comprising:

spreading a second sheet of the first material over the planar surface, a proximal end of the second sheet being placed under a distal end of the first sheet; and securing the second sheet to the planar surface with the plurality of anchors; and connecting the distal end of the first sheet and the proximal end of the second sheet together by passing at least one of the plurality of anchors through a first set of holes in a first flap adhered to the distal end of the first sheet and corresponding second set of holes at the proximal end of the second sheet, thereby lengthening the waterslide.

14. The method of claim 11, wherein the plurality of reinforcing strips comprises a woven fabric.

15. The method of claim 11, wherein the plurality of reinforcing strips is fixed to the first sheet around a periphery.

16. A waterslide assembly, comprising:

a first sheet of a first material, comprising:

a top surface; and a bottom surface opposite the top surface;

a plurality of reinforcing portions fixed to, and positioned entirely on, the bottom surface of the sheet of material around a perimeter of the first sheet;

and a plurality of anchors, comprising a staple-like shape including a securing portion connected to a plurality of elongated prongs;

wherein the first sheet is reversibly fixed to planar surface with the bottom surface facing down, the first sheet being secured in place by the plurality of anchors passing through a plurality of apertures, the reinforcing portions, and the first sheet into the planar surface.

17. The assembly of claim 16, wherein the plurality of reinforcing portions each comprise a first portion adhered to the first sheet and a second portion adhered to itself forming a flap.

18. The assembly of claim 16, further comprising a plurality of apertures passing through at least a portion of the plurality of reinforcing portions.

19. The assembly of claim 16, further comprising:

a second sheet of a second material with reinforcing portions, the second sheet adjacent to the first sheet; the second sheet secured to the planar surface with the plurality of anchors wherein the plurality of anchors passing through at least a portion of the plurality of reinforcing portions;

wherein the first sheet and the second sheet are connected at adjacent lateral sides by inserting a number of the plurality of anchors through the first sheet and the second sheet and into the planar surface, thereby widening a width of the waterslide assembly.

20. The assembly of claim 16, further comprising:

a second sheet of a second material with reinforcing portions, the second sheet having a proximal end that is positioned at least partially under a distal end of the first sheet, the second sheet being secured to the planar surface with the plurality of anchors, wherein the plurality of anchors passing through at least a portion of the plurality of reinforcing portions;

wherein the distal end of the first sheet and the proximal end of the second sheet are reversibly fixed together by passing at least one of the plurality of anchors through at least one of reinforcing portions at the distal end of the first sheet and corresponding reinforcing portion at the proximal end of the second sheet, thereby lengthening a length of the waterslide assembly.

21. The assembly of either of claim 19 or 20, wherein the first material and second material are the same.

22. The assembly of either of claim 19 or 20, wherein the first material and second material are polymers.

23. The system of claim 16, wherein the plurality of reinforcing portions comprises a woven fabric.

* * * * *